US006869467B2

(12) United States Patent
Scheuch

(10) Patent No.: US 6,869,467 B2
(45) Date of Patent: Mar. 22, 2005

(54) DUST FILTER WITH FILTER SLEEVE, EMISSION ELECTRODE AND COLLECTING ELECTRODE

(75) Inventor: Alois Scheuch, Ried im Innkreis (AT)

(73) Assignee: Scheuch GmbH, Aurolzmuster (AT)

( * ) Notice: Subject to any disclaimer, the term of this patent is extended or adjusted under 35 U.S.C. 154(b) by 128 days.

(21) Appl. No.: 10/296,737

(22) PCT Filed: May 31, 2001

(86) PCT No.: PCT/AT01/00179

§ 371 (c)(1),
(2), (4) Date: Apr. 29, 2003

(87) PCT Pub. No.: WO01/91908

PCT Pub. Date: Dec. 6, 2001

(65) Prior Publication Data

US 2003/0159584 A1 Aug. 28, 2003

(30) Foreign Application Priority Data

May 31, 2000 (AT) ..... A 960/2000

(51) Int. Cl.[7] ..... B03C 3/155
(52) U.S. Cl. ..... 96/55; 55/DIG. 38; 95/70
(58) Field of Search ..... 96/55–59; 95/63, 95/70; 55/DIG. 38

(56) References Cited

U.S. PATENT DOCUMENTS

| | | | | | |
|---|---|---|---|---|---|
| 1,853,393 | A | | 4/1932 | Anderson | 95/70 |
| 2,064,960 | A | * | 12/1936 | Thorne | 95/63 |
| 2,785,769 | A | | 3/1957 | Pollack | 95/70 |
| 3,839,185 | A | * | 10/1974 | Vicard | 204/665 |
| 3,910,779 | A | * | 10/1975 | Penney | 96/66 |
| 3,915,676 | A | * | 10/1975 | Reed et al. | 96/32 |
| 4,147,522 | A | * | 4/1979 | Gonas et al. | 95/68 |
| 4,357,151 | A | * | 11/1982 | Helfritch et al. | 95/68 |
| 5,158,580 | A | * | 10/1992 | Chang | 95/70 |
| 5,217,511 | A | * | 6/1993 | Plaks et al. | 96/55 |
| 5,938,818 | A | | 8/1999 | Miller | 95/63 |
| 6,152,988 | A | * | 11/2000 | Plaks et al. | 95/58 |
| 6,524,369 | B1 | * | 2/2003 | Krigmont | 95/78 |
| 6,544,317 | B2 | * | 4/2003 | Miller | 95/63 |
| 2002/0134237 | A1 | * | 9/2002 | Miller | 95/63 |

FOREIGN PATENT DOCUMENTS

| | | |
|---|---|---|
| DE | 438834 | 12/1926 |
| DE | 195 21 320 | 12/1996 |
| DE | 198 41 973 | 3/2000 |

* cited by examiner

*Primary Examiner*—Richard L. Chiesa
(74) *Attorney, Agent, or Firm*—Merchant & Gould P.C.

(57) ABSTRACT

The invention relates to a dust filter, with at least one dust filter sleeve (1), closed at the bottom end thereof, impinged on from the outside by the dust-containing gases, including at least one electrofilter (3), with at least one collecting electrode (4). According to the invention, the filter effect may be improved, by means of increasing the degree of dust separation, whereby the at least one emission electrode (2) is arranged behind the at least one collecting electrode (4), as viewed from the filter sleeve (1). The filter sleeve (1) and associated support cages (7) are preferably electrically isolated. During cleaning of the filter sleeves (1) the ionised dust particles (5) fall for the greater part on the directly adjacent collecting electrode (4).

13 Claims, 3 Drawing Sheets

DUST FILTER WITH FILTER SLEEVE, EMISSION ELECTRODE AND COLLECTING ELECTRODE

Dust-containing waste gases occur in many industrial fields, e.g. in wood working, in the production of chip and fiber boards, in the metallurgical industry, in casting plants, in the building material industry or in metal production.

As a rule, various filters like fabric filters or electrostatic precipitators are used to clean dust-loaded waste gases. Fabric filters usually are comprised of filter bags with closed bag ends, to which crude gas is mostly fed externally, with the pure gas escaping from the open bag end. The filter bags are made of suitable fabrics to which the impurities will adhere. Dedusting of such filter bags is effected by means of compressed air pulses of short duration. During dedusting, the gas flow is reversed within the filter fabric and the adhering dust cake is removed by the inflation of the bag and the resulting acceleration as well as by the scavenging effect caused by the compressed air flow. Depending on the type of impurities and the bag filter used, dedusting can also be effected gently by the aid of low-pressure scavenging air which is blown into the interior of the filter. The particles tossed off the filter bag during dedusting will slide down between the filter bags in the filter housing and are collected, for instance, in a dust collection funnel, and via a refuse worm are transported into a container for disposal or reutilization. In addition to dedusting bag filters by the aid of scavenging air or compressed air, dedusting usually is effected also by shaking the filter bags.

Since with fabric filters a plurality of filter bags are arranged vertically one beside the other, the dust particles tossed off the dedusted bag filter are frequently taken up again by the adjacent filter bag. Moreover, primarily fine dust in the dedusting phase cannot be tossed off sufficiently far from the filter bag and will, therefore, immediately accumulate on the fabric again. This phenomenon is intensified by the transition from the dedusting phase to the filtering phase occurring extremely rapidly. The dust tossed of the filter bags will, thus, get down, for instance, into the dust collection funnel not directly but only via detours. Hence results a relatively high resistance of the fabric filter, which has to be compensated for by a low filter surface load.

In addition to fabric filters, also electrostatic precipitators are used to separate particles from waste gases. Electrostatic precipitators efficiently separate not only solids, but also organic substances and smelling substances. In electrostatic precipitators, the major portion of dust particles is negatively ionized by emission electrodes to which negative direct voltage is applied. The negatively charged dust particles migrate to the positively charged or grounded collecting electrodes and will deposit there over time in the form of dust layers. Both the emission electrodes, on which dust layers are also formed, and the collecting electrodes are dedusted periodically, for instance by beating, and the dust falling off is collected, for instance, in a dust collection funnel and conveyed in containers to further disposal or reutilization, as happens with fabric filters. With wet electrostatic precipitators, dedusting is effected by the aid of liquids which are directed onto the electrodes via injection nozzles arranged above the filter and consequently carry off the impurities together with the scouring liquid. As opposed to fabric filters, dedusting in the event of electrostatic precipitators proceeds more rapidly, because it does not involve the problem of dust particle accumulation after dedusting of the bag filters. On the other hand, fabric filters have higher filtration efficiencies.

Filters that combine the advantages of electrostatic precipitators with the high filtration efficiencies of fabric filters are actually known. Such combinations of bag filters made of cloth with electrostatic precipitators are called hybrid filters. To this end, the high-voltage electrodes of an electrostatic precipitator are, for instance, arranged between the bag filters. Yet, the problem of dust re-accumulation on the bag filters after the dedusting phase has not been overcome to a satisfying degree.

A suggestion for improvement was made in U.S. Pat. No. 5,938,818 A with a hybrid filter comprising a plurality of bag filters arranged in a filter housing and, in addition, plate-shaped grounded electrodes arranged between individual filter bag rows as well as high-voltage electrodes arranged between the filter bag rows such that an electrostatic field is built up on each side of each filter bag row. Dust particles passing this zone are collected on the grounded planar electrode. After this, the prepurified gas flows through the filter bag fabric into the interior, from where it is further conveyed to the pure gas exit. Due to the electrostatic field and the appropriate interspaces between filter bags, high-voltage electrodes and collecting electrodes, most of the particles will accumulate on the collecting electrode. Only a small portion of impurities will deposit on the outer sides of the filter bags. On account of the filter cake thus growing more slowly on the fabric filter, the dedusting intervals can be extended. As the filter bags are being dedusted, the particles are tossed off into the zone between the high-voltage electrode and the collecting electrode and hence transported to the collecting electrode and, for the most part, not attracted again by the outer side of the fabric filter. In order to enhance the bag filter dedusting efficiency, a two-stage dedusting compressed-air pulse is additionally applied, consisting of a first, short compressed-air pulse of high pressure and a subsequent second, prolonged compressed-air pulse of lower pressure. The collecting electrodes are accomplished by reversing the direction of the electric field between the electrodes. Moreover, dedusting of the collecting electrodes can be enhanced by shaking or beating. That construction also entails the drawback that no crude gas flow is provided in the zone between the emission electrodes and the filter bags, and impeded by guide plates in admission zone. The reason for this is that there is no electric field between the emission electrodes and the filter bags, and dust particles from this region would reach the filter bags without being electrically charged. The cited region is, thus, ineffective for dedusting.

The object of the present invention consists in further enhancing the filtering effect by increasing the dust separation efficiency. The drawbacks of known systems are to be avoided or at least reduced.

The object according to the invention is achieved in that, viewed from the filter bag, the at least one emission electrode is arranged behind the at least one collecting electrode. The expression "behind" in this context means that the emission electrode is arranged at a larger distance from the filter bag than the collecting electrode. The electrodes need not be in alignment, but can be arranged in a mutually offset manner. The dust particles ionized in the electric field provided between the emission electrodes and the collecting electrodes migrate to the collection surface and, for the most part, will deposit there. Those dust particles which do not accumulate on the collecting electrodes will reach the filter bags and form dust cakes on the fabric surfaces. The dust particles deposited on the filter bag are, however, ionized, which favors the accumulation on the grounded collecting electrodes during filter bag dedusting by compressed air pulses. It is thereby avoided that, above all, fine dust particles will return to the filter surface immediately after the end of the dedusting pulse and thereby increase the filtering resistance. Substantially higher filter loads will, therefore, be feasible at a simultaneously high dust separation efficiency. This will have positive effects primarily in the event of expensive filter media, since the fabric filter can be kept substantially smaller. As opposed to known dust filters of this type, the area effective for dedusting, of the dust filter according to the invention will consequently be enlarged, thus rendering feasible an increase in the dust separation efficiency and a reduction of the filter size at an unchanged dust separation performance.

Advantageously, the at least one filter bag as well as a support basket optionally provided in the filter bag are electrically insulated such that the electrically charged dust particles adhering to the filter bag fabric will not lose their charge. During dedusting of the filter bags, the charge of the dust particles assists the dust particles in moving in the direction of the grounded collecting electrode.

According to another characteristic feature of the invention, it is provided that the at least one collecting electrode is tubularly designed. This helps to substantially enlarge the surface area of the collecting electrode as opposed to known constructions, whereby the dedusting frequency of the collecting electrode can be lowered and the dust load on the filter bags can be reduced.

According to a further characteristic feature of the invention, it is provided that several tubular collecting electrodes are arranged in a row one beside the other in a spaced-apart relationship. This helps to further enlarge the collection surface. A sufficiently large distance between the collecting electrodes safeguards a sufficiently intense flow of the gas in the filter.

Advantageously, several filter bags each form at least one filter bag row. The filtering surface and hence the separation efficiency of the filter are thereby increased.

If an electrostatic precipitator is arranged at least on one side of each filter bag row as in accordance with the invention, it will be ensured that the gases to be cleaned will always have to pass the ionization zone generated by the electrostatic precipitator, before reaching the filter bags.

Advantageously, at least one emission electrode is arranged between two filter bag rows and at least one collecting electrode is arranged between the at least one emission electrode and each filter bag row. The dedusting of gases loaded with noxious substances is, thus, substantially enhanced.

If at least one collecting electrode is arranged on the external side of at least one outermost filter bag row, the filter area effective for dedusting can be further enlarged, thus further enhancing the filtering effect. Advantageously, at least one collecting electrode is naturally arranged on the external sides of the outermost filter bag rows. The filter bag row, thus, lies between this or these externally located collecting electrode(s) and the emission electrode arranged next within an ionization zone, whereby most of the negatively charged particles will deposit on the collecting electrodes during filter bag dedusting.

According to a further characteristic feature of the invention, it is provided that the at least one collecting electrode is electrically grounded and the at least one emission electrode lies on a negative direct voltage potential.

Advantageously, the at least one filter bag and/or the at least one collecting electrode is/are substantially vertically arranged. Dedusting is thus assisted.

In an advantageous manner, the dust-containing gas is injected substantially in the direction of the filter bag rows. In doing so, it is, however, suitable and advantageous to arrange a substantially vertical guide plate in front of the outermost filter bag of each filter bag row, in the sense of admission of the dust-containing gas. This guide plate covers the filter bags and the collecting electrodes surrounding the same such that the dust-burdened gases will be immediately forced into the ionization zone built up between the emission electrodes and the collecting electrodes, and the ionized dust particles not depositing on the collecting electrodes will move on to the filter bags after having passed the ionization zone. The number and design of the guide plates can be freely chosen as a function of the desired flow conditions.

The invention will be explained in more detail by way of the accompanying drawings. Therein:

Figure 1:
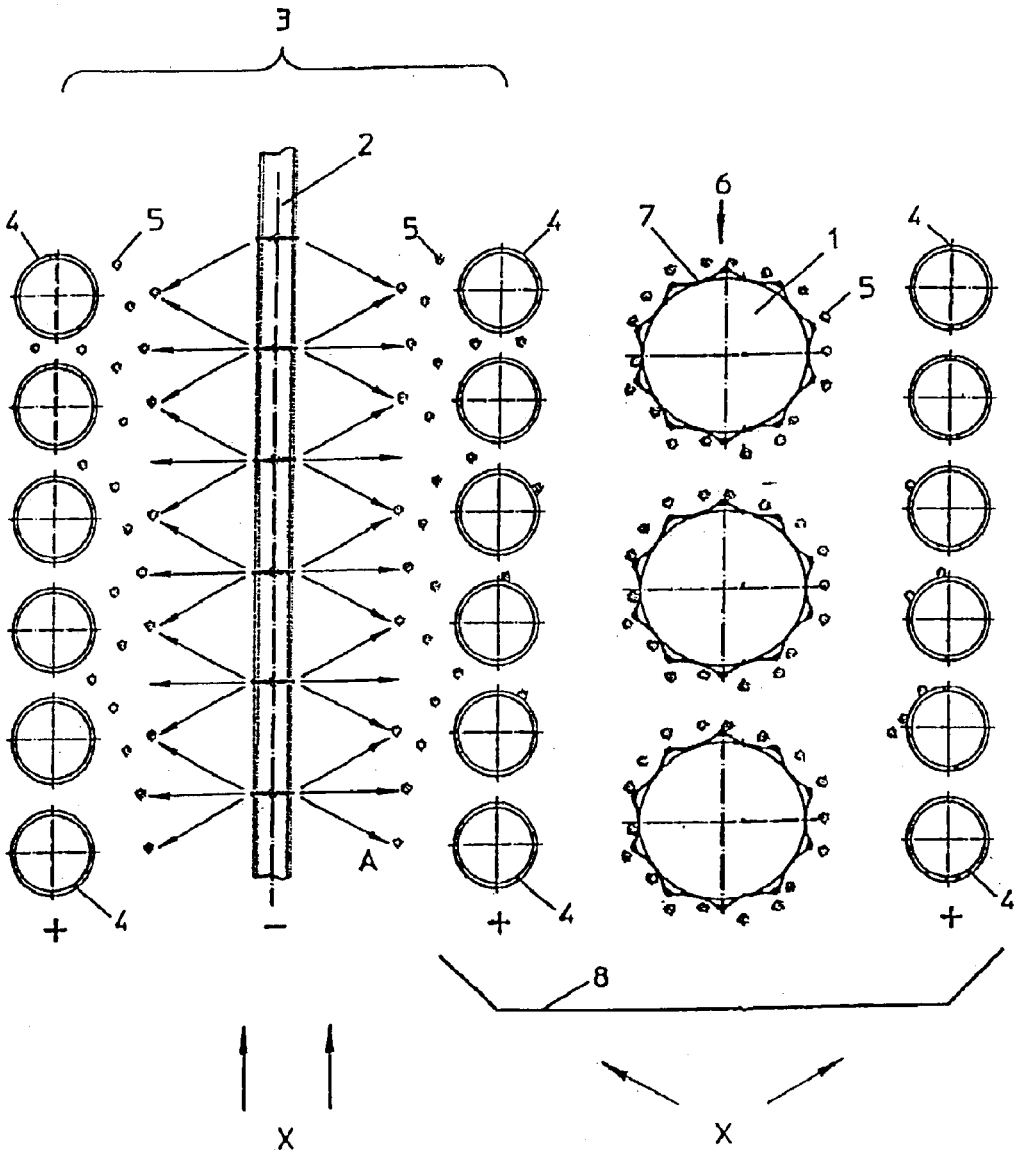
FIG. 1 is a top view on a portion of a dust filter according to one embodiment of the present invention during the filtering phase.

FIG. 1 depicts a filter bag row 6 comprised of three filter bags 1. Beside the filter bag row 6 is arranged an electrostatic precipitator or electrostatic precipitator train 3 comprised of emission electrodes 2 and collecting electrodes 4. Advantageously, collecting electrodes 4 are also arranged on the other side of the emission electrodes 2 and also on the other side of the filter bag row 6. Preferably, the filter bags 1 as well as support baskets 7 optionally arranged therein are electrically insulated. The collecting electrodes 4 preferably are comprised of vertically arranged and spaced-apart tubes which are electrically grounded. The emission electrodes 2 are on a negative direct voltage level, whereby an electric field is built up between the former and the collecting electrodes 4, in which the dust particles 5 are ionized. The electric charges of the respective structural components of the dust filter are identified by "+" and "−" signs, respectively. The dust-containing gas is injected into the dust filter preferably in the direction of the filter bag row 6. The sense of admission is indicated by arrows X. A guide plate 8 which is arranged in front of the filter bag row in a substantially vertical manner and extends horizontally over the collecting electrodes 4 provided on both sides of the filter bag row 6 urges the crude gas into the ionization zone located between the emission electrodes 2 and the collecting electrodes 4, where the dust particles are negatively charged. Most of the ionized dust particles 5 deposit on the surface of the collecting electrodes 4. Only a small portion passes between the collecting electrodes 4 and is conducted by the gas flow to the filter bags 1, where they are deposited on the outer sides of the filter bags 1. The electric field generated between the emission electrodes 2 and the collecting electrodes 4 causes the dust particles 5 to move in the sense of arrow A. As a rule, a dust filter comprises several filter bag rows arranged in parallel. In the present case, one electrostatic precipitator train 3 comprised of an emission electrode 2 and collecting electrodes 4 provided on both sides is each arranged between two filter bag rows 6.

Figure 2:
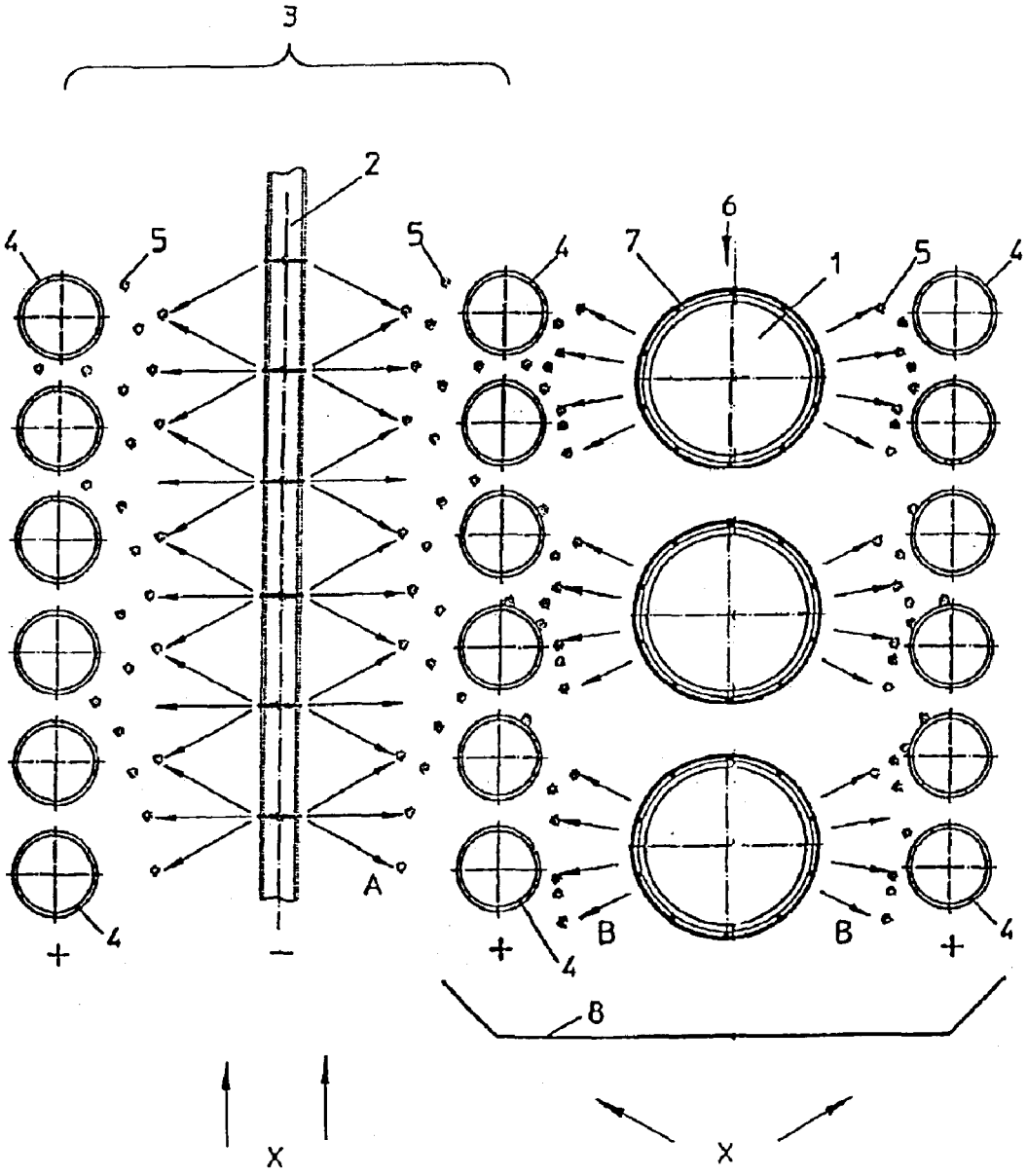
FIG. 2 is a top view on a portion of the filter according to FIG. 1 during the dedusting phase.

During dedusting of the filter bags 1 according to FIG. 2, compressed air pulses are delivered into the open ends of the filter bags 1, which cause the filter bags 1 to inflate and the dust particles 5 adhering thereto to be moved in the sense of arrows B. Since the dust particles 5 have been ionized and the filter bags 1 as well as the optionally provided support baskets 7 are electrically insulated, the dust particles are attracted by the collecting electrodes 4 surrounding the filter bag rows 6 and remain adhering thereto. The electric insulation of the filter bags 1 and the optionally provided support baskets 7 also prevents the occurrence of sparkovers from the emission electrodes 2 to the wires of the support baskets 7, which might damage the fabric of the filter bags 1. Due to the arrangement according to the invention, of collecting electrodes 4 between the emission electrodes 2 and the filter bags 1, the distance between the emission electrodes 2 and the filter bags 1 can be substantially smaller than in known arrangements, where no collecting electrode 4 is provided between the emission electrodes 2 and the filter bags 1. In that case, the distance of the emission electrodes 2 from the filter bags 1 must be substantially larger then the distance of the emission electrodes 2 from the collecting electrodes 4, since sparkovers from the emission electrodes 2 to the wires of the support baskets 7 of the filter bags 1 would otherwise occur at distances too small, thus leading to perforations of the fabric of the filter bags 1. Due to the fact that the filter bags 1 are burdened with dust particles 5 to a slighter extent, they will have to be dedusted only at larger time intervals. Dedusting of the collecting electrodes 4 is preferably effected by beating and also may take place less frequently on account of the enlarged surface area as against plate-shaped electrodes. Unlike conventional hybrid filters, the present filter arrangement according to the invention offers the advantage that a substantially higher filter load may be envisaged at a simultaneously high dust separation efficiency. The separation efficiency of the electric filter train 3 can be substantially enhanced, because the flow speed in the electrostatic precipitator is lower. Unlike the prior art, the present invention offers the advantage that the fine dust during bag filter dedusting will not have to pass again through the ionization zone in order to reach the collection surfaces, but will reach the collecting electrodes 4 directly from the filter bag 1.

Figure 3:
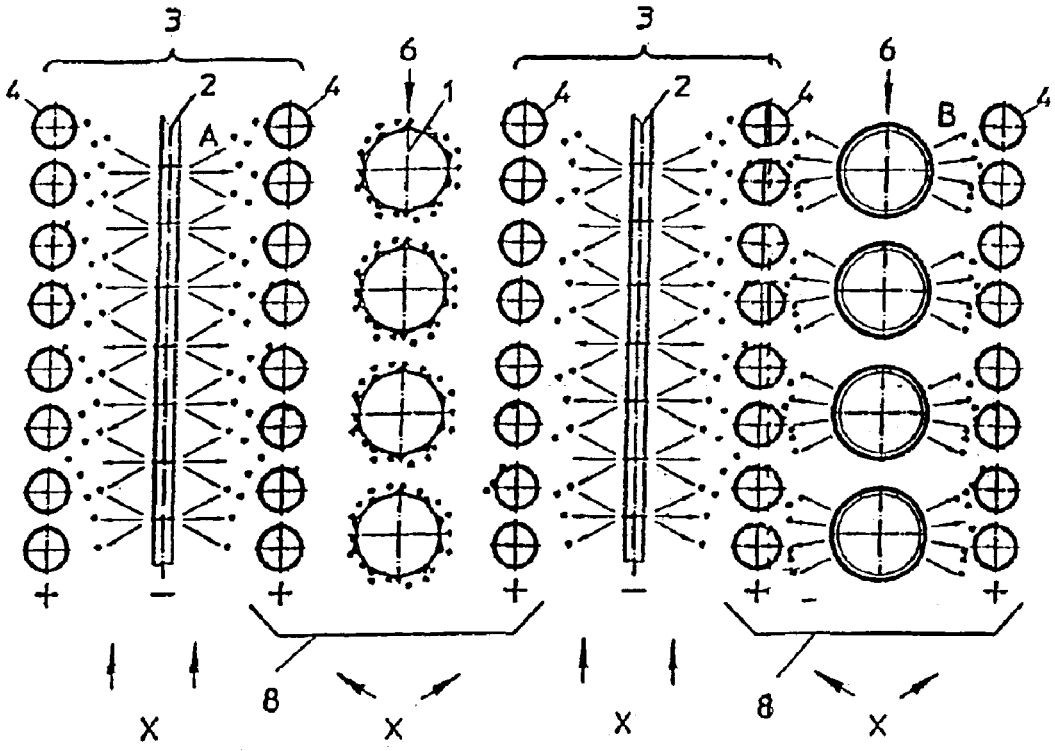
FIG. 3 illustrates a multi-stage dust filter according to the present invention in top view.
Figure 4:
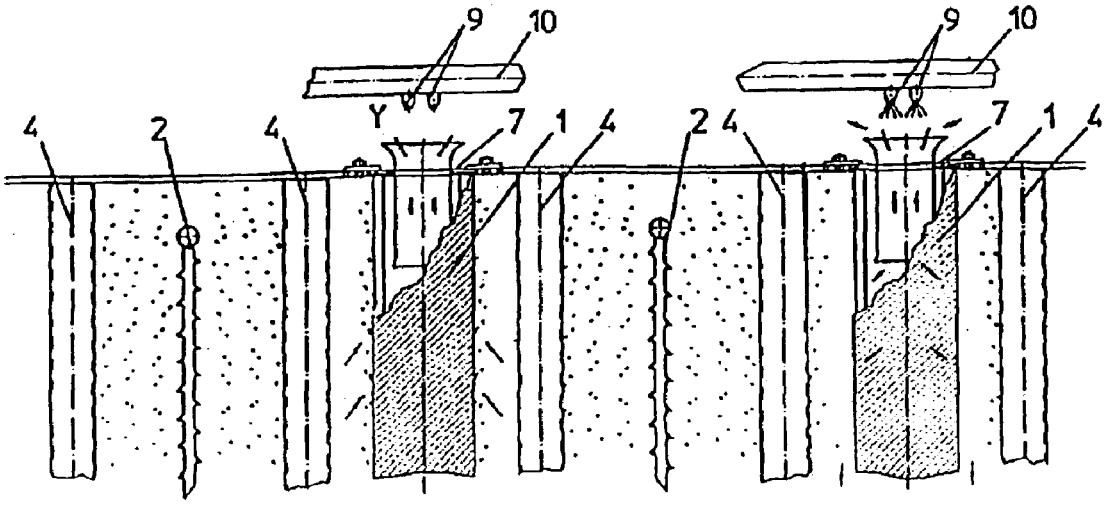
FIG. 4 is a partially sectioned side view of the dust filter according to FIG. 3.

FIGS. 3 and 4 are a top view and a partially sectioned side view, respectively, of a multi-stage dust filter constructed according to the invention, wherein two filter bag rows 6 are illustrated with the filter bag row 6 shown on the left-hand side being in the filtering phase and the right-hand filter bag row 6 being in the dedusting phase. As is apparent from FIG. 4, the nozzles 9 for delivering the compressed air pulses aimed for dedusting the filter bags 1 are provided above the filter bags 1. The compressed air is fed through appropriate compressed air ducts 10, only part of which is illustrated. During dedusting as illustrated in the right-hand portion of the Figures, a compressed air pulse is delivered through the nozzles 9, which is blown into the filter bag 1 equipped with a support basket 7. This causes the downwardly closed filter bag 1 to inflate, whereby the dust particles 5 adhering thereto are moved towards the collecting electrodes 4 in the sense of arrow B. During the filtering phase as illustrated in the left-hand portion of the Figure, the cleaned gas flows along arrows Y through the open end of the filter bags into the clean gas chamber of the filter. The distance between two filter bag rows 6 in the present arrangement may be chosen to be smaller, since a larger filter area is effective for dedusting.

The arrangement between the filter bag rows, of the electrostatic precipitators designed according to the invention can be repeated as frequently as desired as a function of the number of filter stages and size of the cleaning device.

What is claimed is:

1. A dust filter comprising at least one filter bag (1) closed on its bottom end, to which dust-containing gases are fed externally, and at least one electrostatic precipitator (3) including at least one collecting electrode (4) and at least one emission electrode (2) lying on a negative potential relative to the at least one collecting electrode (4) such that an ionization zone is formed between the emission electrode (2) and the collecting electrode (4), characterized in that, viewed from the filter bag (1), the at least one emission electrode (2) is arranged behind the at least one collecting electrode (4) and that the dust-containing gases during the filtering phase of the filter pass through the same in a manner so as to pass the ionization zone prior to passing the filter bags (1).

2. A filter according to claim 1, characterized in that the at least one filter bag (1) as well as a support basket (7) optionally provided in the filter bag (1) are electrically insulated.

3. A filter according to claim 1, characterized in that the at least one collecting electrode (4) is tubularly designed.

4. A filter according to claim 3, characterized in that several tubular collecting electrodes (4) are arranged in a row one beside the other in a spaced-apart relationship.

5. A filter according to claim 1, characterized in that several filter bags (1) each form at least one filter bag row (6).

6. A filter according to claim 5, characterized in that an electrostatic precipitator is arranged on at least one side of each filter bag row (6).

7. A filter according to claim 5, characterized in that at least one emission electrode (2) is arranged between two filter bag rows (6) and at least one collecting electrode (4) is arranged between the at least one emission electrode (2) and each filter bag row (6).

8. A filter according to claim 7, characterized in that at least one collecting electrode (4) is arranged on the external side of at least one of the outermost filter bag rows (6).

9. A filter according to claim 1, characterized in that at least on collecting electrode (4) is electrically grounded and the at least one emission electrode (2) lies on a negative direct voltage potential.

10. A filter according to claim 1, characterized in that the at least one filter bag (1) is substantially vertically arranged.

11. A filter according to claim 1, characterized in that the at least one collecting electrode (4) is substantially vertically arranged.

12. A filter according to claim 10, characterized in that the dust-containing gas is injected substantially in the direction (X) of the filter bag rows (6).

13. A filter according to claim 12, characterized in that a substantially vertical guide plate (8) is arranged in front of the outermost filter bag (1) of each filter bag row (6), in the sense of admission of the dust-containing gas.

* * * * *